US009521479B2

(12) United States Patent
Lee

(10) Patent No.: US 9,521,479 B2
(45) Date of Patent: Dec. 13, 2016

(54) HEADPHONES AND HEADSETS

(71) Applicant: TECA TECHNOLOGIES LIMITED, Sandgate, Kent (GB)

(72) Inventor: Andrew James Lee, Sandgate (GB)

(73) Assignee: Teca Technologies Limited, Sandgate, Kent (GB)

( * ) Notice: Subject to any disclaimer, the term of this patent is extended or adjusted under 35 U.S.C. 154(b) by 0 days.

(21) Appl. No.: 14/424,628

(22) PCT Filed: Aug. 30, 2013

(86) PCT No.: PCT/GB2013/052287

§ 371 (c)(1),
(2) Date: Feb. 27, 2015

(87) PCT Pub. No.: WO2014/033472

PCT Pub. Date: Mar. 6, 2014

(65) Prior Publication Data

US 2015/0245124 A1 Aug. 27, 2015

(30) Foreign Application Priority Data

Aug. 31, 2012 (GB) ..... 1215554.5

(51) Int. Cl.
*H04R 25/00* (2006.01)
*H04R 1/10* (2006.01)
*H04R 5/033* (2006.01)

(52) U.S. Cl.
CPC ..... *H04R 1/105* (2013.01); *H04R 5/0335* (2013.01)

(58) Field of Classification Search
CPC ..... H04R 1/10; H04R 5/0335; H04R 1/105
(Continued)

(56) References Cited

U.S. PATENT DOCUMENTS 7,292,703 B2 11/2007 Kaulfuss et al.
7,940,947 B2 5/2011 Kaulfuss et al.
(Continued)

FOREIGN PATENT DOCUMENTS

CH 602 037 A5 7/1978
CN 2 054 962 U 3/1990
(Continued)

OTHER PUBLICATIONS

International Search Report Corresponding to PCT/GB2013/052287 mailed Aug. 11, 2014.

*Primary Examiner* — Sunita Joshi
(74) *Attorney, Agent, or Firm* — Davis & Bujold PLLC; Michael J. Bujold

(57) ABSTRACT

Headphones or a headset comprise a pair of electro-acoustic transducers (1, 2), both ear-pieces and an earpiece and a microphone are carried at opposite ends of a curved headband (3) that is formed by a chain of links (500-511) that are hinged to one another and the transducers (1, 2). Each link (5) involves a shell-casing (8) that on an underside has a first pair of mutually-spaced projecting lugs (9) and has a second pair of mutually-spaced projecting lugs (10) that nest with the first pair of lugs (9) of the next-following link (5). The nested lugs (9, 10) are pierced transversely and pivot pins (11) are inserted in the piercings to establish hinges (7) between the links (5). The transducers (1, 2) are hinged to the ends of the headband (3) to enable the headphones or headset to be rolled up lengthwise of the headband (3).

14 Claims, 6 Drawing Sheets

(58) Field of Classification Search
USPC ..... 381/370–374, 384
See application file for complete search history.

(56) References Cited

U.S. PATENT DOCUMENTS

| | | | | |
|---|---|---|---|---|
| 2005/0053255 | A1* | 3/2005 | Harris | H04R 5/0335 381/379 |
| 2010/0177907 | A1 | 7/2010 | Morisawa | |
| 2011/0002497 | A1* | 1/2011 | Fukuma | H04R 5/0335 381/374 |
| 2013/0243236 | A1* | 9/2013 | Chamness | H04R 1/10 381/378 |

FOREIGN PATENT DOCUMENTS

| | | | |
|---|---|---|---|
| CN | 2 485 904 | Y | 4/2002 |
| DE | 33 32 496 | A1 | 3/1985 |
| DE | 10 2007 037 412 | A1 | 2/2009 |
| EP | 1 479 261 | B1 | 11/2004 |
| GB | 2 320 996 | A | 7/1998 |

* cited by examiner

HEADPHONES AND HEADSETS

This application is a National Stage completion of PCT/GB2013/052287 filed Aug. 30, 2013, which claims priority from British patent application serial no. 1215554.5 filed Aug. 31, 2012.

FIELD OF THE INVENTION

This invention relates to headphones and headsets.

SUMMARY OF THE INVENTION

It is an object of the present invention to provide headphones and headsets that are each readily foldable into a compact form.

According to the present invention there is provided headphones or a headset in which a pair of electro acoustic transducers (both of which are ear-pieces in the case of headphones whereas one may be an ear-piece and the other may be a microphone in the case of a headset) are carried at opposite ends of a headband, wherein the headband comprises to chain of links that are hinged in series one to another and to the electro-acoustic transducers at either end so as to enable the headphones or headset to be rolled up lengthwise of the headband with one of the transducers located centrally within the roll and the other on the outside of the roll.

Each Link of the headphones or headset according to the invention, may be hinged to a next-adjacent link in the chain for pivoting relative to it about an axis transverse to the headband. Also, each link may comprise a casing that has a pair of mutually-spaced pierced lugs that project from one end of the casing for alignment of their piercings with the piercings of a pair of mutually-spaced lugs within the casing of a next-adjacent link of the chain. One or two pivot pins may be inserted through the all piercings of the lugs to hinge the two links together. In these latter circumstances, the casings at the opposite ends of the headband may each have a pair of mutually-spaced pierced lugs that project for alignment of their piercings with the piercings of a pair of mutually-spaced lugs of the transducer at that respective end of the headband, a hinge connection between the respective casing and the transducer being established by one or two pivot pins inserted through these aligned piercings.

The lengths lengthwise of the headband of some of the links may be different from the lengths lengthwise within the headband of others of the links in order to facilitate compactness in the rolling up of the headband spirally onto the transducer located centrally within the roll. In these circumstances, end links of the headband hinged respectively directly to the transducers, and a pair of links centrally-located along the length of the headband, may each be shorter lengthwise of the headband than others of the links.

An external cable connection to one of the transducers may be extended to the other transducer via an electrical connection extends within the headband.

Where a headset is involved the transducer on the outside of the roll is preferably the microphone.

BRIEF DESCRIPTION OF THE DRAWINGS

Headphones in accordance with the present invention will now be described, by way of example, with reference to the accompanying drawings, in which.

DETAILED DESCRIPTION OF THE PREFERRED EMBODIMENTS

Figure 1:
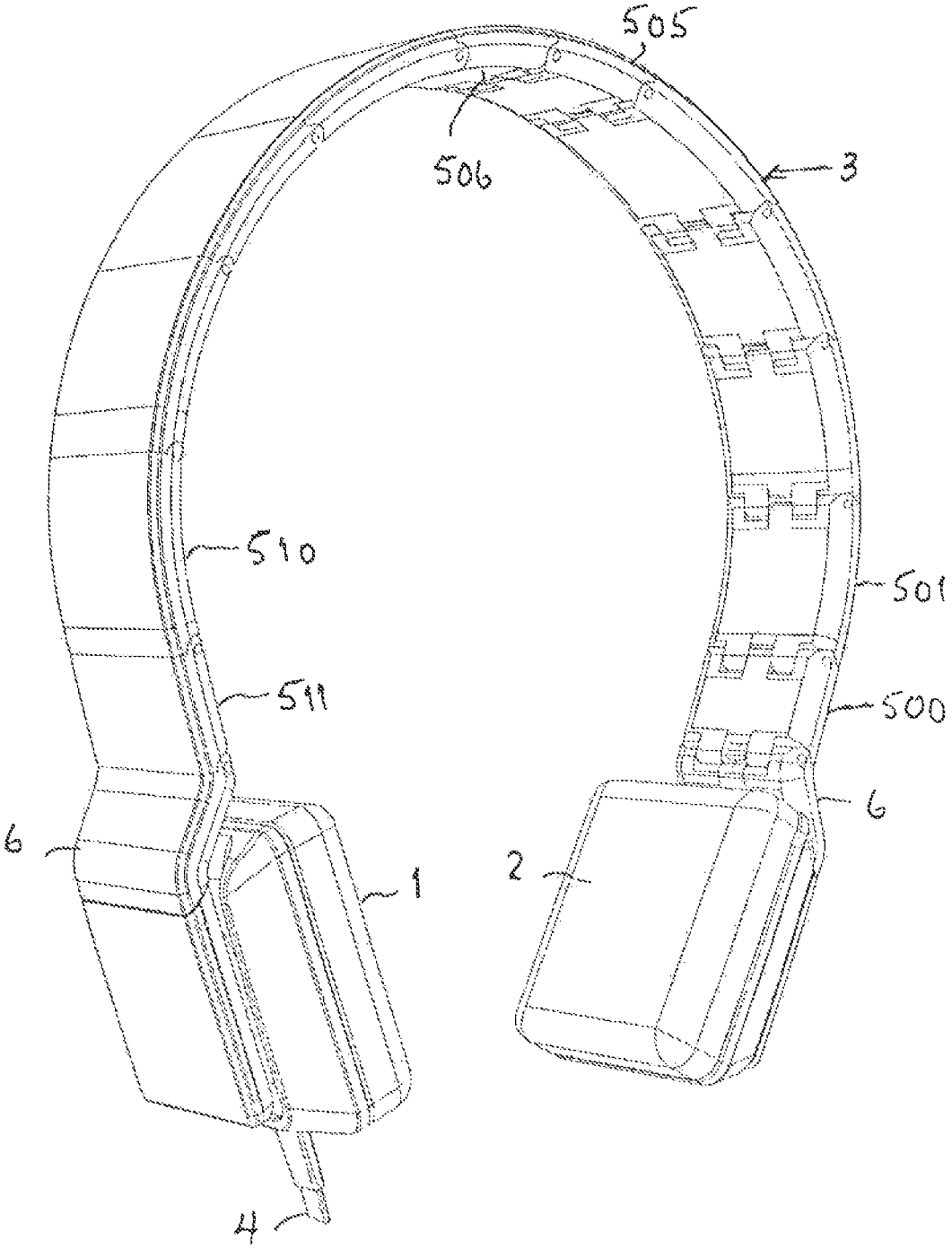
FIG. 1 is a perspective view from one side of the headphones according to the invention.

Referring to FIG. 1, the headphones comprise a pair of electro-acoustic transducers in the form of ear-pieces 1 and 2 that are mounted apart from one another at opposite ends of a curved headband 3. Although not shown in the drawings, the headband 3 has a soft fabric covering for the comfort of the user, and electrical connection from an input lead 4 to ear-piece 1 is extended to eat-piece 2 within the headband 3 as later described.

Figure 2:
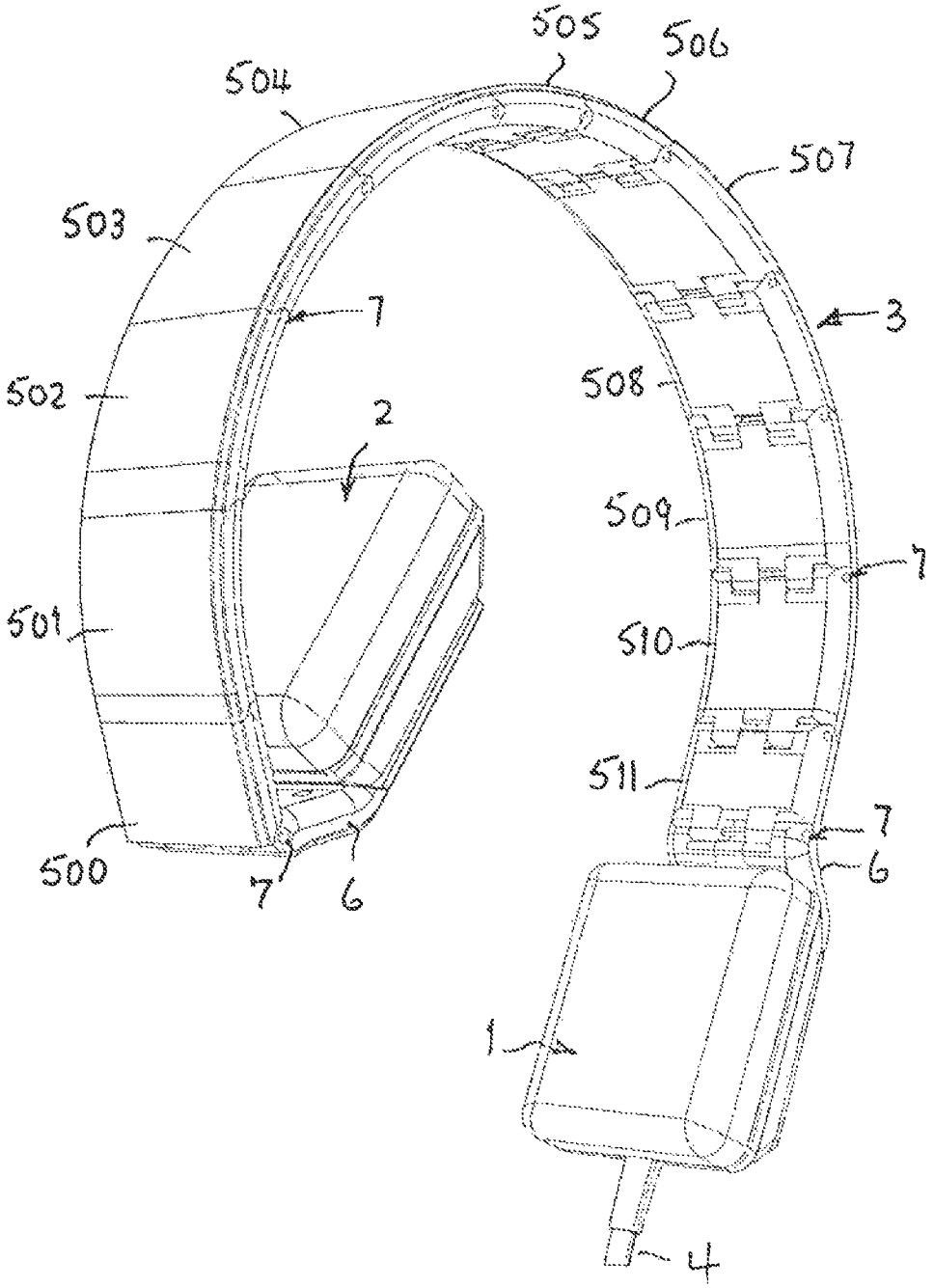
FIG. 2 is a perspective view of the headphones from the opposite side to that of FIG. 1, at an initial stage of the folding or rolling-up into a compact form.

The headband 3 is made up of a chain of twelve serially-hinged links 5 (identified individually as links 500-511) that are hinged to individual mountings 6 of the ear-pieces 1 and 2 at opposite ends of the headband 3. The links 5 are all hinged transversely of the length of the headband 3 so as to enable the headband 3 to be rolled up spirally lengthwise on itself together with the ear-pieces 1 and 2, into a compact form, More especially, the spiral rolling-up process begins as illustrated in FIG. 2 by the turning over of the ear-piece 2 onto the headband 3. This is facilitated by a hinge 7 between the mounting 6 of the ear-piece 2 and end link 500 of the headband 3. There is a similar hinge 7 between the mounting 6 of the ear-piece 1 and the link 511 at the opposite end of the headband 3.

The end links 500 and 511 and the central-pair of links 505 and 506 of the headband 3, are each shorter than each of the other eight links 501-504 and 507-510. More especially, there is variation in the lengths of the links 500-505 that is reflected correspondingly in the lengths of the links 511-506 (in that order). These differences in length facilitate the compactness of the spiral folding- or rolling-up of the headphones. More particularly, the differences are chosen for the most compact accommodation of the ear-piece 2 in the centre of the spiral roll-up, and of the headband 3 wrapped round it, but the construction of each of the links is essentially the same in principle as that of each other.

Figure 3:
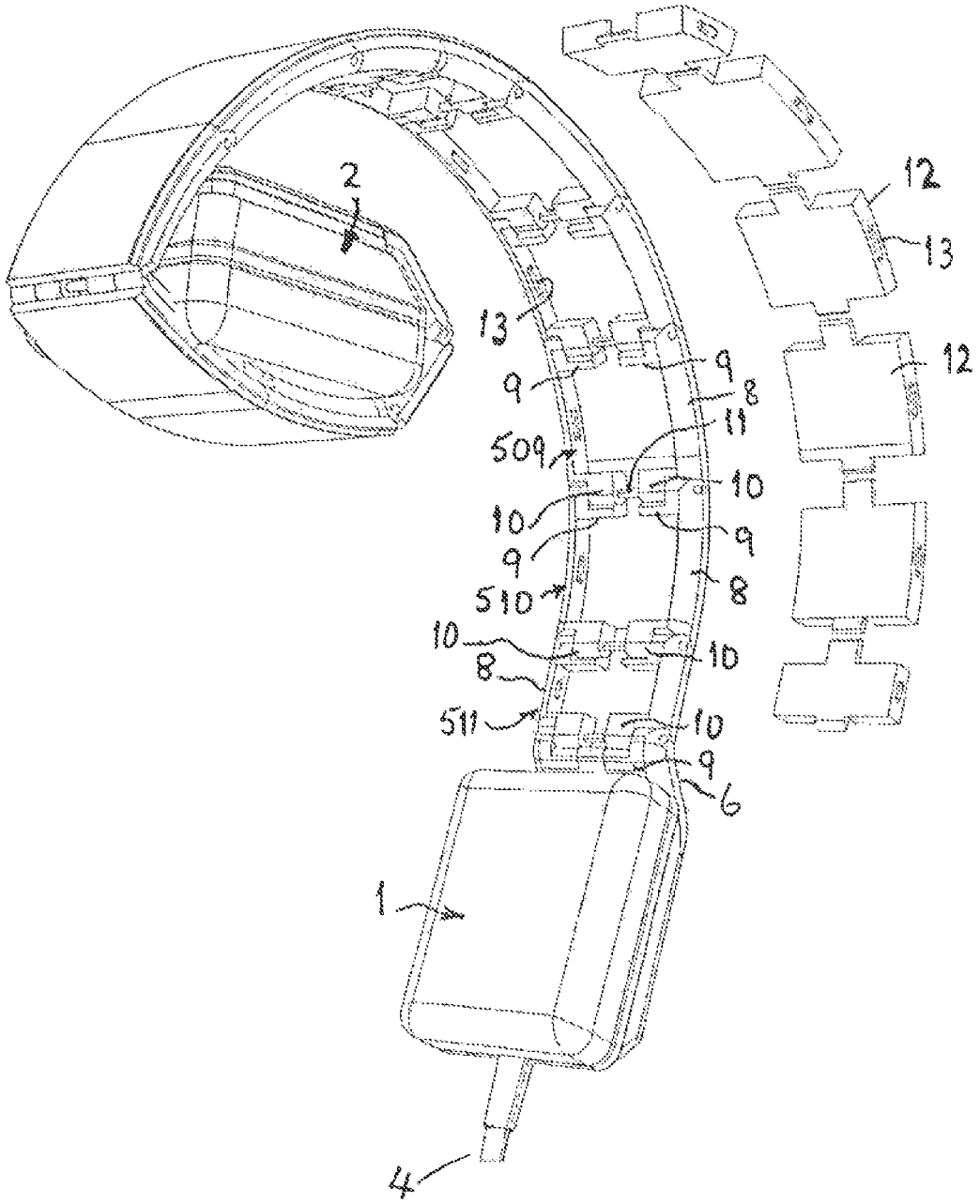
FIG. 3 is a partially-exploded view of the headphones the invention at a later stage of the rolling-up than represented in FIG. 2.
Figure 4:
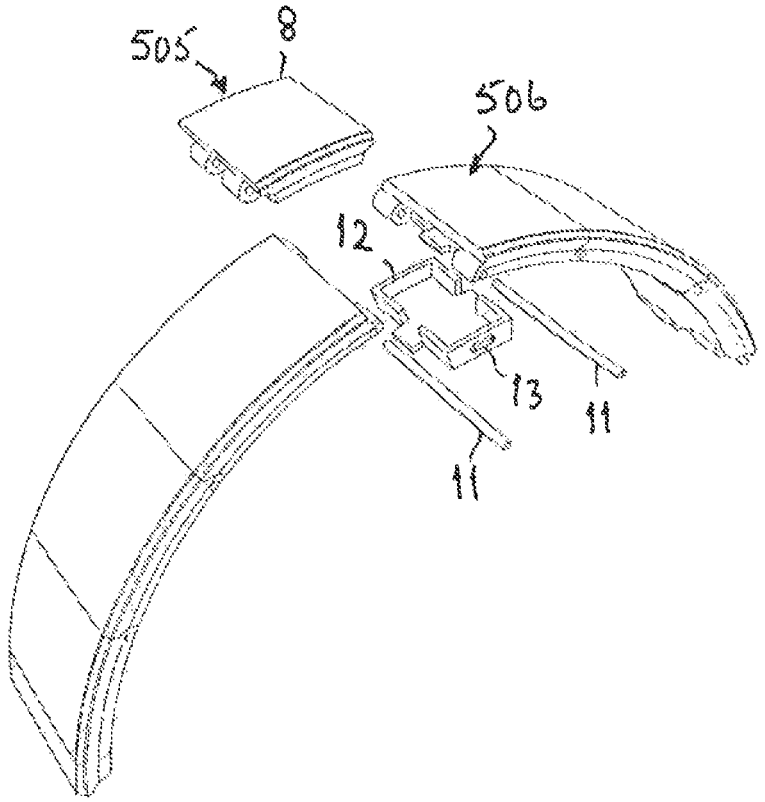
FIG. 4 shows an exploded view of one the links of the headband of the headphones of the invention.

In the latter respect, and as more-clearly illustrated in FIGS. 3 and 4 (especially for the links 509 and 511 in FIG. 3), each link 5 has a shell-casing 8 that is formed within its underside at one end with a pair of mutually-spaced lugs 9, and with a pair of mutually-spaced lugs 10 that project from the other end of the casing 8 to nest within the lugs 9 of the next-following link 5 in the chain sequence of links 500-511. The nested lugs 9 and 10 of the links 5 are pierced transversely, and pivot 11 which are retained inserted through the aligned piercings, establish the hinges 7 between the links 5.

The mounting 6 of the ear-piece 1 has pierced lugs corresponding to the lugs 9 that nest the projecting, pierced lugs 10 of the link 511. A pivot bin 11 is retained inserted through the aligned piercings of the two sets of lugs 9 and 10 so as to establish the hinge 7 between the mounting 6 of the ear-piece 1 and the link 511. Mounting 6 of the ear-piece 2, on the other hand, has projecting lugs corresponding to the lugs 10 for nesting with the lugs 9 of the link 500, and a pivot pin 11 retained through their aligned piercings establishes the hinge 7 between the mounting 6 of the ear-piece 2 and the link 500.

Filler-pieces 12 are inserted and retained in the open undersides of the casings 8 after an electrical cable (not shown) is laid down to extend through the casings 8 from one to the other of the ear-pieces 1 and 2. The filler-pieces 12 retain the cable in place in the headband 3 being themselves retained in the casings 8 by inter-engagement between spring clips 13 on the filler pieces 12 and within the side-walls of casings 8. Polyurethane foam or a moulded strip of silicone may be secured on top of the filler-pieces 12, or may replace the filler-pieces altogether.

Figure 5:
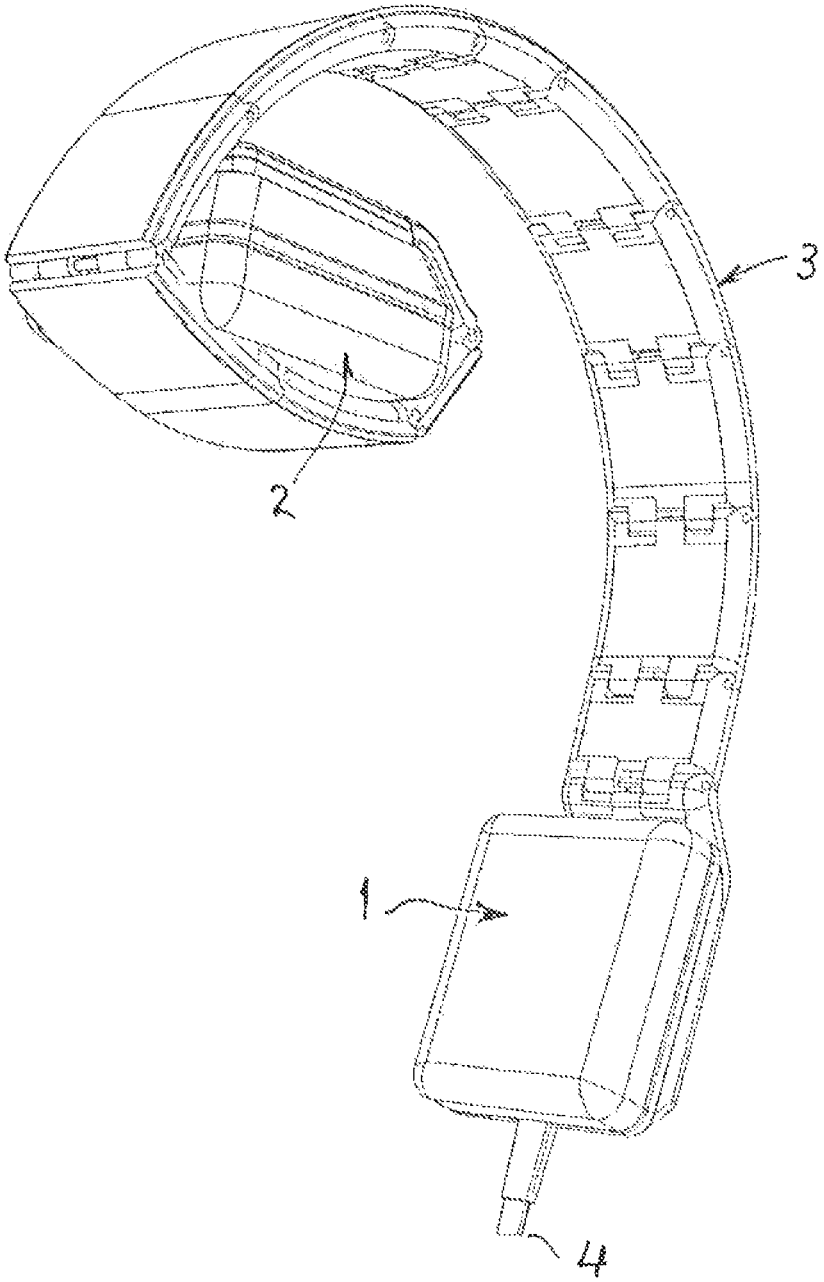
FIG. 5 is a perspective view of the headphones of the invention at a later stage of the spiral rolling-up than represented in FIG. 2.
Figure 6:
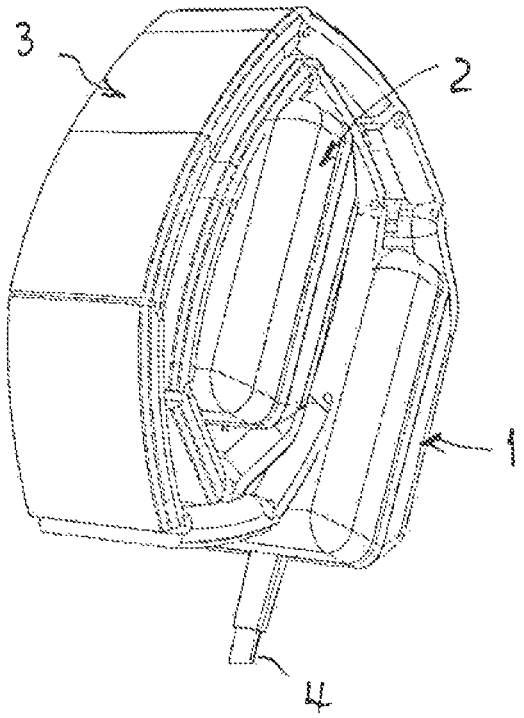
FIG. 6 is a perspective view of the headphones of the invention at a final stage of the roiling up spirally into the compact form.

As illustrated in FIG. 5, rolling up of the headphones continues from the stage represented in FIG. 2 to wrap more of the headband 3 onto the ear-piece 2 until, as represented in FIG. 6, roll-up is completed with the ear-piece 1 turned onto the roll. The input lead 4 can now be wrapped round the roll for retention of the headphones in compact form.

Joints (not shown) for extension of the headband 3 may be incorporated at both ends of the headband 3 where it is coupled to the ear-pieces 1 and 2, so that adjustment may be made to the headphones for comfort to the user.

Although the above description with reference to the drawings is confined to the application of the invention to headphones, it will be appreciated that the invention also applicable to the provision of a headset. More especially, such a headset may utilise the same construction of headband as the headband 3 with an ear-piece corresponding to the ear-piece 2 hinged to it, and differ from the headphones described simply in the replacement of the ear-piece 1 with a microphone. The microphone used may be mounted on a pivoting arm or boom, or may be incorporated into the lead 4 or the cable within the headband 3 to the ear-piece 2.

The invention claimed is:

1. A headset comprising a headband having first and second ends, and first and second electro-acoustic transducers carried at the first and the second ends respectively of the headband, wherein the headband comprises a chain of links that are hinged in series one to another and to the first and the second electro-acoustic transducers at the respective first and second ends of the headband so as to enable the headset to be rolled up spirally lengthwise of the headband into a spiral roll with the first electro-acoustic transducer located centrally within the spiral roll and the second electro-acoustic transducer located on the outside of the spiral roll, some of the links of the chain differ from others of the links of the chain in length lengthwise of the headband in order to facilitate compactness in the rolling up of the headband spirally onto the first electro-acoustic transducer located centrally within the spiral roll, and each link is hinged to a next-adjacent link in the chain for pivoting relative to said next-adjacent link about an axis transverse to the headband.

2. A headset comprising a headband having first and second ends, and first and second electro-acoustic transducers carried at the first and second ends respectively of the headband, wherein the headband comprises a chain of links that are hinged in series one to another and to the first and second electro-acoustic transducers at the respective first and second ends of the headband so as to enable the headset to be rolled up lengthwise of the headband into a roll with the first electro-acoustic transducer located centrally within the roll and the second electro-acoustic transducer located on the outside of the roll, and some of the links of the chain differ from others of the links of the chain in length lengthwise of the headband in order to facilitate compactness in the rolling up of the headband onto the first electro-acoustic transducer located centrally within the roll, and further each link of the chain of links comprises a casing that has a first pair of mutually-spaced pierced lugs that project from one end of the casing for alignment of piercings of the first pair of mutually-spaced lugs with piercings of a second pair of lugs that project from a casing of a next-adjacent link of the chain, and the first pair of mutually-spaced lugs are pivoted to the second pair of mutually-spaced lugs to hinge the first and second pairs of mutually-spaced lugs together.

3. Headphones comprising a headband having first and second ends, and first and second electro-acoustic ear-piece transducers hinged to the first and the second ends respectively of the headband, wherein the headband comprises a chain of links that are hinged in series one to another so as to enable the headphones to be rolled up lengthwise of the headband into a roll with the first electro-acoustic ear-piece transducer located centrally within the roll and the second electro-acoustic ear-piece transducer located on the outside of the roll, and some of the links of the chain differ in length lengthwise of the headband from others of the links in order to facilitate compactness in the rolling up of the headband onto the first electro-acoustic ear-piece transducer located centrally within the roll, and further each link of the chain of links comprises a casing that has a first pair of mutually-spaced pierced lugs that project from one end of the casing for alignment of piercings of the first pair of mutually-spaced lugs with piercings of a second pair of lugs that project from a casing of a next-adjacent link of the chain, and the first pair of mutually-spaced lugs are pivoted to the second pair of mutually-spaced lugs to hinge the first and second pairs of mutually-spaced lugs together.

4. The headset according to claim 2, wherein the first and the second electro-acoustic transducers are carried by individual mountings located at the first and second ends respectively of the headband, each of the mountings has a pair of mutually-spaced pierced lugs that project from the respective mounting for alignment of piercings with piercings of a pair of mutually-spaced pierced lugs of an end-link of the headband, and a pivot-pin hinge connection is established between the mutually-spaced lugs of the mounting and the mutually-spaced lugs of the end-link.

5. The headset according to claim 1, wherein end-links at the first and the second ends of the headband respectively are hinged directly to the first and the second electro-acoustic transducers respectively, and the end-links are each shorter lengthwise of the headband than others of the links of the headband.

6. The headset according to claim 1, wherein an external cable connection to the second electro-acoustic transducer is extended to the first electro-acoustic transducer via an electrical connection which extends within the headband.

7. The headset according to claim 1, wherein the second electro-acoustic transducer on the outside of the spiral roll is a microphone.

8. The headset according to claim 7, wherein the first electro-acoustic transducer is an ear-piece.

9. The headset according to claim 1, wherein each link of a pair of links of the headband located centrally of the chain of links is shorter lengthwise of the headband than some others of the links.

10. Headphones comprising a headband having first and second ends, and first and second electro-acoustic ear-piece transducers hinged to the first and the second ends respectively of the headband, wherein the headband comprises a chain of links that are hinged in series one to another so as to enable the headphones to be rolled up spirally lengthwise of the headband into a spiral roll with the first electro-acoustic ear-piece transducer located centrally within the spiral roll and the second electro-acoustic ear-piece transducer located on the outside of the spiral roll, some of the links of the chain differ in length lengthwise of the headband from others of the links in order to facilitate compactness in the rolling up of the headband spirally onto the first electro-acoustic ear-piece transducer located centrally within the spiral roll, and each link of a pair of links of the headband located centrally of the chain of links is shorter lengthwise of the headband than some others of the links.

11. The headphones according to claim 10, wherein each link is hinged to a next-adjacent link in the chain for pivoting relative to said next-adjacent link about an axis transverse to the headband.

12. The headphones according to claim 3, wherein the first and the second electro-acoustic transducers are carried by individual mountings located at the first and second ends respectively of the headband, each of the mountings has a pair of mutually-spaced pierced lugs that project from the respective mounting for alignment of piercings with piercings of a pair of mutually-spaced pierced lugs of an end-link of the headband, and a pivot-pin hinge connection is established between the mutually-spaced lugs of the mounting and the mutually-spaced lugs of the end-link.

13. The headphones according to claim 10, wherein end-links at the first and the second ends of the headband respectively are hinged directly to the first and second electro-acoustic ear-piece transducers respectively, and the end-links are each shorter lengthwise of the headband than others of the links of the headband.

14. The headphones according to claim 10, wherein an external cable connection to the second electro-acoustic ear-piece transducer is extended to the first electro-acoustic ear-piece transducer via an electrical connection which extends within the headband.

* * * * *